US010575077B2

(12) United States Patent
Yang et al.

(10) Patent No.: US 10,575,077 B2
(45) Date of Patent: Feb. 25, 2020

(54) SPEAKER AND SPEAKER MODULE

(71) Applicant: GOERTEK INC., Weifang, Shandong (CN)

(72) Inventors: Fan Yang, Weifang (CN); Qing Miao, Weifang (CN)

(73) Assignee: GOERTEK INC., Weifang, Shandong (CN)

( * ) Notice: Subject to any disclaimer, the term of this patent is extended or adjusted under 35 U.S.C. 154(b) by 0 days.

(21) Appl. No.: 16/084,493

(22) PCT Filed: Dec. 16, 2016

(86) PCT No.: PCT/CN2016/110299

§ 371 (c)(1),
(2) Date: Sep. 12, 2018

(87) PCT Pub. No.: WO2018/000757

PCT Pub. Date: Jan. 4, 2018

(65) Prior Publication Data

US 2019/0082246 A1 Mar. 14, 2019

(30) Foreign Application Priority Data

Jun. 29, 2016 (CN) ..... 2016 1 0498618

(51) Int. Cl.
*H04R 1/02* (2006.01)
*H04R 9/02* (2006.01)
*H04R 9/04* (2006.01)

(52) U.S. Cl.
CPC ..... *H04R 1/025* (2013.01); *H04R 9/025* (2013.01); *H04R 9/045* (2013.01)

(58) Field of Classification Search
CPC ..... H04R 9/06; H04R 9/045; H04R 9/025; H04R 1/025

(Continued)

(56) References Cited

U.S. PATENT DOCUMENTS

2007/0169387 A1* 7/2007 Glass ..... G09F 1/00 40/124.03
2014/0029783 A1* 1/2014 Yang ..... H04R 1/02 381/395
2015/0063607 A1 3/2015 Li et al.

FOREIGN PATENT DOCUMENTS

CN 204498303 U 7/2015
CN 205249477 U * 5/2016

(Continued)

*Primary Examiner* — Melur Ramakrishnaiah
(74) *Attorney, Agent, or Firm* — Saliwanchik, Lloyd & Eisenschenk

(57) ABSTRACT

The present invention relates to a speaker, and speaker module. The speaker comprises a housing and two electrical connection members mounted on the housing, each electrical connection member comprises a second pad portion exposed from a side wall of the housing, and the second pad portion is disposed in parallel to the side wall of the housing. The speaker further comprises a circuit board attached to the side wall of the housing, and the circuit board is electrically connected to the second pad portions. The speaker of the present invention enables attaching the circuit board to the side wall of the housing, thus increasing operation space, and reducing operational risks. By attaching the circuit board to the side wall of the housing, the present invention reduces interference of the circuit board on a terminal antenna, and reduces the possibility of the circuit board involving in vibration of a back chamber, thus improving the performance of the speaker. Meanwhile, by providing the circuit board on the side wall of the housing, the present invention simplifies the shape of the circuit board, thus providing a compact layout, and accordingly saving costs.

10 Claims, 3 Drawing Sheets

(58) Field of Classification Search
USPC ..... 381/388, 300, 307, 191, 116, 386
See application file for complete search history.

(56) References Cited

FOREIGN PATENT DOCUMENTS

| | | | |
|---|---|---|---|
| CN | 205249477 | U | 5/2016 |
| CN | 105959887 | A | 9/2016 |
| CN | 205912248 | U | 1/2017 |

* cited by examiner

SPEAKER AND SPEAKER MODULE

CROSS REFERENCE TO RELATED APPLICATIONS

This application is a National Stage of International Application No. PCT/CN2016/110299, filed on Dec. 16, 2016, which claims priority to Chinese Patent Application No. 201610498618.4, filed on Jun. 29, 2016, both of which are hereby incorporated by reference in their entireties.

FIELD OF THE INVENTION

The present invention relates to the field of sound producing devices, and more particularly, to a speaker. The present invention further relates to a speaker module.

BACKGROUND OF THE INVENTION

Speakers, as important acoustic components in electronic equipment, are transducing apparatus for converting electrical signals into sound signals. A speaker unit comprises a mounting housing, as well as a magnetic circuit assembly, a vibration assembly and other parts which are disposed in the mounting housing.

Currently, pads of speaker units on the market are located in a Z-axis direction of products. Referring to FIG. 8, a speaker unit comprises a housing a and pads b disposed on the upper end surface of the housing a. Generally, there are two pads b. The two pads b are distributed in the length direction or the width direction of the unit. In this way, an FPCB (Flexible Printed Circuit Board) c connected with the speaker unit will need a larger mounting space due to the positions of the pads on the unit. Thus, a required space for a module is increased. So, the module with a smaller size cannot provide enough space for mounting the FPCB. Nowadays, the sizes of the products are increasingly reduced, so do the sizes of the modules. Therefore, it is urgent to replace a connection way of the pads.

SUMMARY OF THE INVENTION

An object of the present invention is to provide a speaker.

According to an aspect of the present invention, there is provided a speaker, comprising: a housing and two electrical connection members mounted on the housing, wherein each electrical connection member comprises a second pad portion which is exposed from a side wall of the housing and is disposed in parallel to the side wall of the housing. The speaker further comprises a circuit board which is attached to the side wall of the housing and is electrically connected to the second pad portions.

Optionally, the circuit board is an FPCB comprising a long strip section whose upper and lower sides are approximately parallel to each other; and two third pad portions are sequentially disposed on the long strip section, and are electrically connected with the two second pad portions on the side wall of the housing, respectively.

Optionally, the housing is rectangular; and the two second pad portions are located on the side walls of the long sides or short sides of the housing, or are located on the side walls of one long side and one short side of the housing.

Optionally, the electrical connection members are injection-molded with the housing.

Optionally, grooves are formed in the side wall of the housing and correspond to the two second pad portions respectively; and the second pad portion is exposed from the bottom surface of the corresponding groove.

Optionally, all or at least a part of the second pad portion in its thickness direction is embedded in the housing; and the outer surface of the second pad portion is flush with the bottom surface of the corresponding groove, or is higher than the bottom surface of the groove but not higher than the side wall of the housing.

Optionally, the inner surface of the second pad portion is flush with the bottom surface of the corresponding groove; and the outer surface of the second pad portion is not higher than the side wall of the housing.

Optionally, the electrical connection member further comprises: a first pad portion which is exposed from the inner side of the end surface of the housing and is electrically connected to a lead of a voice coil in the speaker; and a bending portion which is connected with the first pad portion and the second pad portion and is injection-molded in the housing.

Optionally, the first pad portions and the second pad portions are located on two planes approximately perpendicular to each other.

According to another aspect of the present invention, there is provided a speaker module, comprising a housing assembly and the above speaker mounted in the housing assembly.

In the speaker provided by the present invention, the first pad portions exposed from the end surface of the housing are connected with the lead of the voice coil, and the second pad portions exposed from the side wall of the housing are connected with the circuit board, so that the voice coil and the circuit board are connected together. Through the connection structure provided by the present invention, the circuit board can be attached to the side wall of the housing, so that an operation space is increased, and an operation risk is reduced. By attaching the circuit board to the side wall of the housing, interference of the circuit board on a terminal antenna is reduced, and the possibility of the circuit board involving in vibration of a back chamber is reduced, so that the performance of the speaker is improved to some extent. Meanwhile, by providing the circuit board on the side wall of the housing, the shape of the circuit board is simplified, thus providing a compact layout, and accordingly saving costs.

Further features of the present invention and advantages thereof will become apparent from the following detailed description of exemplary embodiments according to the present invention with reference to the accompanying drawings.

BRIEF DESCRIPTION OF THE DRAWINGS

The accompanying drawings, which constitute a part of the description, illustrate embodiments of the present invention and, together with the description thereof, serve to explain the principles of the present invention.

DETAILED DESCRIPTION OF THE EMBODIMENTS

Figure 1:
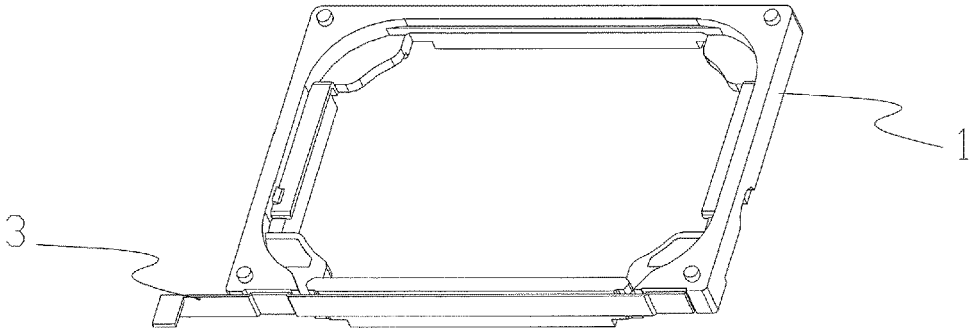
FIG. 1 is a schematic view of a partial structure of a speaker provided by the present invention.
Figure 2:
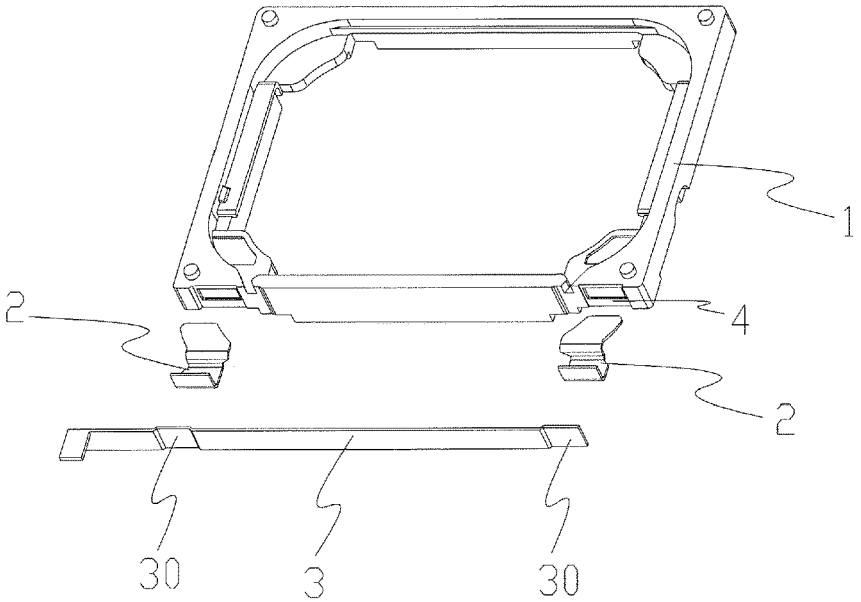
FIG. 2 is an exploded view of FIG. 1.
Figure 3:
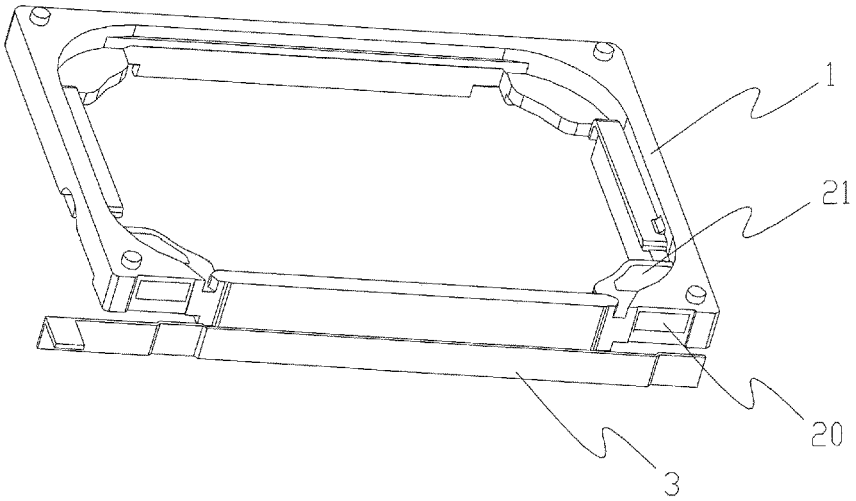
FIG. 3 is a schematic view when one electrical connection member and a housing in FIG. 1 are combined.
Figure 4:
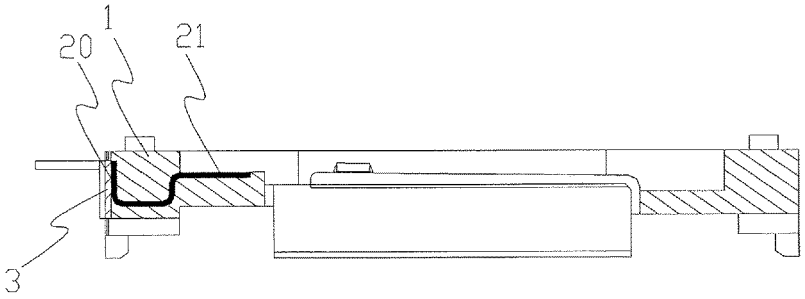
FIG. 4 is a section view of FIG. 1
Figure 5:
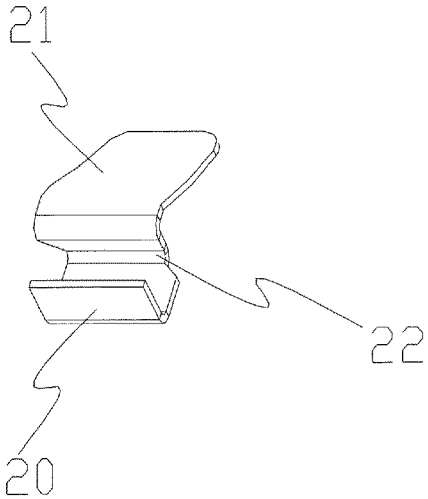
FIG. 5 is a schematically structural view of the electrical connection member provided by the present invention.

Various exemplary embodiments of the present invention will now be described in detail with reference to the drawings. It should be noted that the relative arrangement of the components and steps, the numerical expressions, and numerical values set forth in these embodiments do not limit the scope of the present invention unless it is specifically stated otherwise.

The following description of at least one exemplary embodiment is merely illustrative in nature and is in no way intended to limit the present invention, its application, or uses.

Techniques and equipment as known by one of ordinary skill in the relevant art may not be discussed in detail but are intended to be part of the description where appropriate.

In all of the examples illustrated and discussed herein, any specific values should be interpreted to be illustrative only and non-limiting. Thus, other examples of the exemplary embodiments could have different values.

Notice that similar reference numerals and letters refer to similar items in the following figures, and thus once an item is defined in one figure, it is possible that it need not be further discussed in the accompanying drawings.

Referring to FIGS. 1 to 5, the present invention provides a speaker, comprising: a housing 1 and electrical connection members 2 injection-molded in the housing 1. Generally, there are two electrical connection members 2. The two electrical connection members 2 may be distributed in the length direction or the width direction of the housing 1, which is specifically selected according to actual needs of those skilled in the art. Each electrical connection member 2 comprises a first pad portion 21 exposed from the end surface of the housing 1, a second pad portion 20 exposed from the side wall of the housing 1, and a bending portion 22 connected with the first pad portion 21 and the second pad portion 20.

The electrical connection member 2 of the present invention may be integrally formed. For example, the first pad portion 21, the second pad portion 20 and the bending portion 22 may be formed on the electrical connection member 2 by bending. The electrical connection member 2 is injection-molded in the housing 1 as an insert. Preferably, the edges of both the first pad portion 21 and the second pad portion 20, and the bending portion 22 of the electrical connection member 2 are injection-molded in the housing 1, so that the electrical connection member 2 and the housing 1 are combined. Moreover, the first pad portion 21 and the second pad portion 20 are exposed from the corresponding positions in the housing 1. Preferably, the first pad portion 21 and the second pad portion 20 are respectively located on two planes approximately perpendicular to each other.

The first pad portion 21 is exposed from the end surface of the housing 1, so that a lead of a voice coil located at this side of the housing 1 can be connected to the first pad portion 21 to connect the lead of the voice coil to the electrical connection member 2. The second pad portion 20 is exposed from the side wall of the housing 1, and is disposed in parallel to the side wall of the housing 1. In this structure, a circuit board 3 may be disposed on the side wall of the housing 1, is attached to the side wall of the housing 1, and is electrically connected to the second pad portion 20, so that the lead of the voice coil and the circuit board 3 are connected through the electrical connection member 2. If the housing is rectangular, the two second pad portions 20 may be disposed on the side walls of the long sides or short sides of the housing 1, or the side walls of one long side and one short side of the housing 1.

In a preferred embodiment of the present invention, the circuit board 3 is an FPCB comprising a long strip section whose upper and lower sides are approximately parallel to each other. Two third pad portions 30 are sequentially disposed on the long strip section, and are electrically connected with the two second pad portions 20 on the side wall of the housing 1, respectively. By adopting the FPCB with this shape, the layout during manufacturing can be more compact, thereby saving costs.

Figure 6:
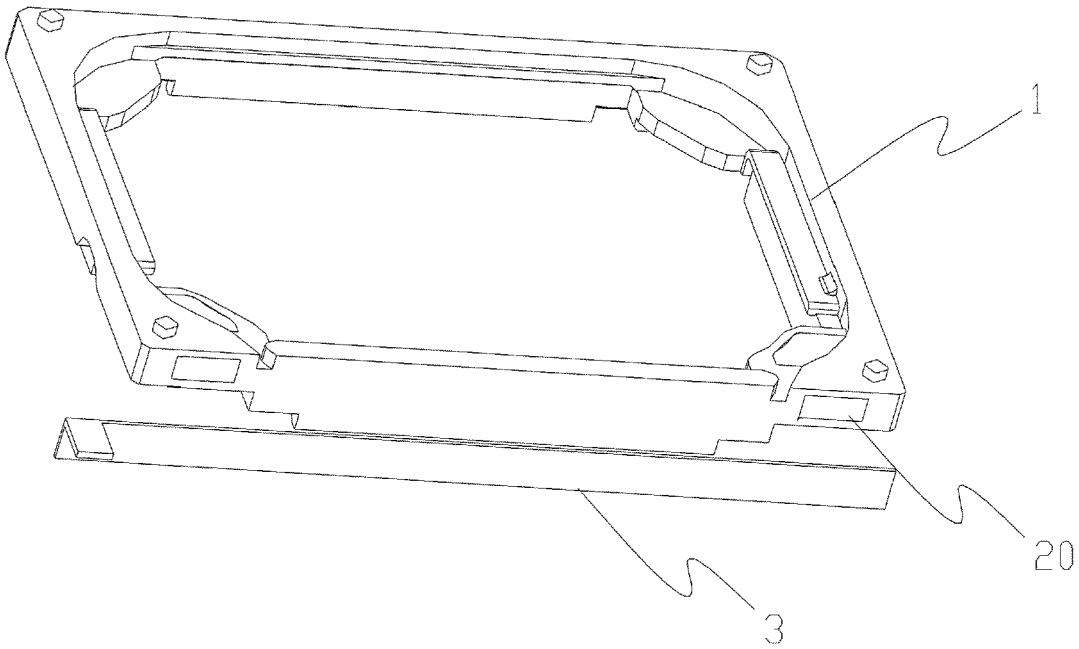
FIG. 6 is a schematic view when one electrical connection member and the housing are combined in another embodiment.
Figure 7:
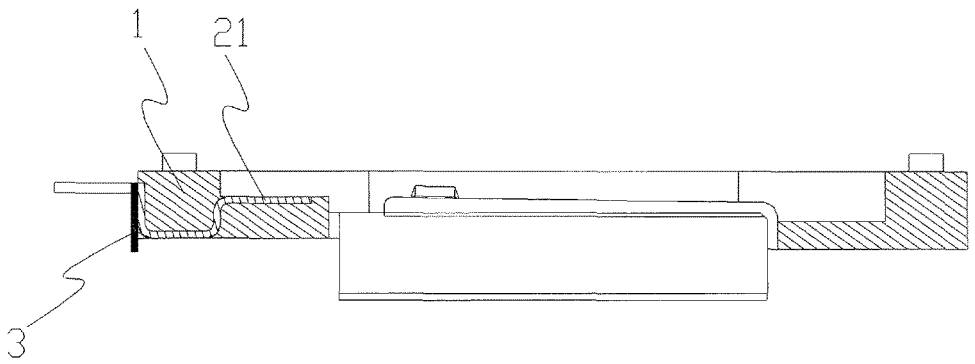
FIG. 7 is a section view of FIG. 6.
Figure 8:
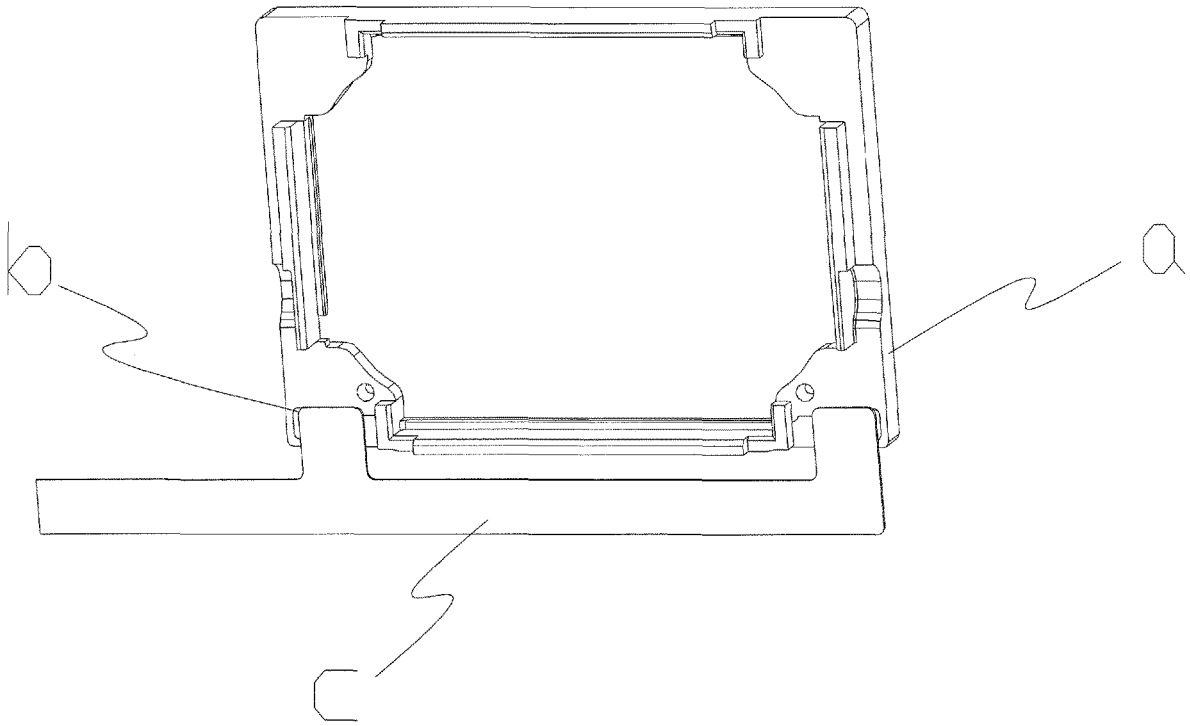
FIG. 8 is a schematic view of a partial structure of a speaker in the prior art.

Referring to FIGS. 6 and 7, during injection molding, the second pad portions 20 of the present invention may be flush with the side wall of the housing 1. Preferably, grooves 4 are formed in the side wall of the housing 1 and correspond to the two second pad portions 20 respectively; and the second pad portion 20 is exposed from the bottom surface of the corresponding groove 4. With the grooves 4, a manufacturing process is simplified, so that it is ensured that the outer surface of the second pad portion 20 is not higher than the side wall of the housing 1.

For example, during injection molding, all or at least a part of the second pad portion 20 in its thickness direction is embedded in the housing 1. The outer surface of the second pad portion 20 is flush with the bottom surface of the corresponding groove 4, or is higher than the bottom surface of the groove 4 but not higher than the side wall of the housing 1.

Further, the inner surface of the second pad portion 20 is flush with the bottom surface of the corresponding groove 4; and the outer surface of the second pad portion 20 is not higher than the side wall of the housing 1.

Through the above structure, the outer surface of the second pad portion 20 is lower than the side wall of the housing 1. After the circuit board 3 is welded on the second pad portions 20, the structure of the entire speaker is compact, so that the welding position of the circuit board 3 on the second pad portions 20 will not occupy too much space.

In the speaker provided by the present invention, the first pad portions exposed from the end surface of the housing are connected with the lead of the voice coil, and the second pad portions exposed from the side wall of the housing are connected with the circuit board, so that the voice coil and the circuit board are connected together. Through the connection structure provided by the present invention, the circuit board can be attached to the side wall of the housing, so that an operation space is increased, and an operation risk is reduced. By attaching the circuit board to the side wall of the housing, interference of the circuit board on a terminal antenna is reduced, and the possibility of the circuit board involving in vibration of a back chamber is reduced, so that the performance of the speaker unit is improved to some extent.

The present invention further provides a speaker module, comprising: a housing assembly and the above speaker mounted in the housing assembly. By mounting the above speaker in the housing assembly, the size of the speaker module is reduced.

Although some specific embodiments of the present invention have been demonstrated in detail with examples, it should be understood by a person skilled in the art that the above examples are only intended to be illustrative but not to limit the scope of the present invention. It should be understood by those skilled in the art that the above embodiments can be modified without departing from the scope and spirit of the present invention. The scope of the present invention is defined by the appended claims.

What is claimed is:

1. A speaker, comprising: a housing and two electrical connection members mounted on the housing, wherein each electrical connection member comprises a second pad portion which is exposed from a side wall of the housing and is disposed in parallel to the side wall of the housing;

and the speaker further comprises a circuit board which is attached to the side wall of the housing and is electrically connected to the second pad portions.

2. The speaker of claim 1, wherein the circuit board is an FPCB comprising a long strip section whose upper and lower sides are approximately parallel to each other; two third pad portions are sequentially disposed on the long strip section, and are electrically connected with the two second pad portions on the side wall of the housing, respectively.

3. The speaker of claim 1, wherein the housing is rectangular; and the two second pad portions are located on the side walls of the long sides or short sides of the housing (1), or are located on the side walls of one long side and one short side of the housing (1).

4. The speaker of claim 2, wherein the electrical connection members are injection-molded with the housing.

5. The speaker of claim 4, wherein grooves are provided in the side wall of the housing and correspond to the two second pad portions respectively; and the second pad portion is exposed from the bottom surface of the corresponding groove.

6. The speaker of claim 5, wherein all or at least a part of the second pad portion in its thickness direction is embedded in the housing; the outer surface of the second pad portion is flush with the bottom surface of the corresponding groove, or is higher than the bottom surface of the corresponding groove but not higher than the side wall of the housing.

7. The speaker of claim 5, wherein the inner surface of the second pad portion is flush with the bottom surface of the corresponding groove; and the outer surface of the second pad portion is not higher than the side wall of the housing.

8. The speaker of any of claim 4, wherein the electrical connection member further comprises:

a first pad portion which is exposed from the end surface of the inner side of the housing and is electrically connected to a lead of a voice coil in the speaker; and a bending portion, which connects the first pad portion to the second pad portion, is injection-molded in the housing.

9. The speaker of claim 8, wherein the first pad portions and the second pad portions are located on two planes approximately perpendicular to each other.

10. A speaker module, comprising: a housing assembly and the speaker of claim 1 mounted in the housing assembly.

* * * * *